US005128226A

United States Patent [19]

Hung

[11] Patent Number: 5,128,226

[45] Date of Patent: Jul. 7, 1992

[54] ELECTROPHOTOGRAPHIC ELEMENT CONTAINING BARRIER LAYER

[75] Inventor: Yann Hung, Rochester, N.Y.

[73] Assignee: Eastman Kodak Company, Rochester, N.Y.

[21] Appl. No.: 803,743

[22] Filed: Dec. 4, 1991

Related U.S. Application Data

[63] Continuation of Ser. No. 434,378, Nov. 13, 1989, abandoned.

[51] Int. Cl.[5] ..... G03G 5/14; G03G 5/047

[52] U.S. Cl. ..... 430/58; 430/59; 430/64; 430/900

[58] Field of Search ..... 430/58, 59, 64, 900

[56] References Cited

U.S. PATENT DOCUMENTS

| | | | |
|---|---|---|---|
| 3,428,451 | 2/1969 | Trevoy | 430/64 |
| 3,554,742 | 1/1971 | Gramza et al. | 430/64 |
| 3,761,259 | 9/1973 | Mai et al. | 430/64 |
| 3,887,369 | 6/1975 | Matsuko et al. | 430/64 |
| 4,006,020 | 2/1977 | Polasuli | 428/461 |
| 4,012,255 | 3/1977 | McMullen | 428/327 |
| 4,106,934 | 8/1978 | Turnblom | 430/900 X |
| 4,601,941 | 7/1986 | Lutz et al. | 428/461 X |
| 4,818,653 | 4/1989 | Wiedemank et al. | 430/58 X |
| 4,933,246 | 6/1990 | Teuscher | 430/64 |

FOREIGN PATENT DOCUMENTS

| | | | |
|---|---|---|---|
| 49-46263 | 12/1974 | Japan | 430/64 |
| 57-161750 | 10/1982 | Japan | 430/64 |
| 614415 | 7/1978 | U.S.S.R. | 430/64 |

*Primary Examiner*—Roland Martin

*Attorney, Agent, or Firm*—Dressler, Goldsmith, Shore, Sutker & Milnamow

[57] ABSTRACT

A photoconductor element of the type comprising successive layers of a support layer, a barrier layer, a charge generation layer, and an n-type charge transport layer wherein the barrier layer is less than about 1.0 micron in thickness and is comprised of (1) at least one monoethylenically unsaturated aliphatic dicarboxylic acid anhydride containing 4 through 8 carbon atoms per molecule, and (2) at least one vinyl monomer wherein the weight ratio of (1) to (2) is in the range of about 10:1 to 1:10.

5 Claims, No Drawings

ELECTROPHOTOGRAPHIC ELEMENT CONTAINING BARRIER LAYER

This application is a continuation of application Ser. No. 07/434,378, filed Nov. 13, 1989, now abandoned.

FIELD OF THE INVENTION

This invention is in the field of multilayered photoconductor elements containing improved barrier layers, particularly elements containing n-type charge transport layers.

BACKGROUND OF THE INVENTION

Multilayered photoconductor elements incorporating a polystyrene charge barrier layer, and having a thickness of about 0.1 to 2 microns are disclosed in U.S. Pat. No. 2,901,348.

U.S. Pat. No. 3,554,742 discloses an electrophotographic element that contains a barrier layer comprising block copolycarbonates.

A barrier layer of cellulose nitrate about 1.5 microns thick between a recording layer (e.g., silver halide or photoconductive composition) and a conductive layer is disclosed in U.S. Pat. No. 3,428,451.

Although many various polymers are known for use in barrier layers of photoconductor elements, there is an ongoing need for particular barrier layers which provide optimum effects in specific types of multilayer elements.

SUMMARY OF THE INVENTION

This invention provides a multilayered photoconductor element that incorporates a barrier layer that is less than about 1 micron in thickness and which comprises a copolymer of:

(1) at least one monoethylenically unsaturated aliphatic dicarboxylic acid anhydride containing 4 through 8 carbon atoms per molecule; and (2) at least one vinyl monomer; wherein the weight ratio of (1) to (2) is in the range of about 10:1 to 1:10.

The photoconductor element of the present invention comprises successive mutually adhered layers of:

a support layer;
a conductive layer;
a barrier layer;
a charge generation layer; and
an n-type charge transport layer.

When a photoconductor element of this invention has the surface of its charge transport agent positively charged, it exhibits surprisingly low dark decay.

Other and further advantages, features, and the like that are associated with the present invention will be apparent to those skilled in the art from the accompanying specification taken with the appended claims.

DETAILED DESCRIPTION OF THE INVENTION

The term "vinyl monomer" as used herein means a compound having the vinyl group ($CH_2{=}CH{-}$). Vinyl monomers are highly reactive, and polymerize easily.

Examples of vinyl monomers include ethylene; styrene; vinyl methyl ether; vinyl ethyl ether; vinyl ether; vinyl isobutyl ether; acrylonitrile; alpha methyl styrene; vinyl cyclohexene; vinyl halides such as vinyl bromide, vinyl chloride, vinylidene chloride, vinyl fluoride, and vinylidene fluoride; vinyl 2-ethylhexyl ether; vinyl acetylene; N-vinylcarbazole; cetylvinyl ether; vinyl 2-chloro ethyl ether; 2-vinyl-5-ethyl pyridine; vinyl methyl ketone; N-vinyl-2-pyrrolidone; and the like. Presently preferred vinyl monomers are ethylene, styrene and vinyl methyl ether.

Presently preferred unsaturated aliphatic dicarboxylic acid anhydrides are those having a furan nucleus, and the presently most preferred such anhydride is maleic anhydride.

Presently preferred copolymers are those wherein the weight ratio of unsaturated aliphatic dicarboxylic acid anhydride to vinyl monomer is in the range of about 1:5 to 5:1.

Examples of suitable copolymers include ethylene/maleic anhydride copolymers, methyl vinyl ether/maleic anhydride copolymers, styrene/maleic anhydride copolymers, and the like.

The copolymers of monoethylenically unsaturated aliphatic dicarboxylic acid anhydrides with vinyl monomers can be made by any convenient procedure. For example, the method taught in "Macromolecular Syntheses", J. H. Johnson, Vol. 1, pp. 42–45 (1963) can be used.

The photoconductor elements of this invention can employ, as a non-conducting support or support layer, a suitable film or sheet material such as has been heretofore employed to produce prior art photoconductor elements. Presently preferred supports are comprised of cellulose acetate, polystyrene, polycarbonate, or a polyester, such as polyethylene terephthalate.

Various electrically conductive layers can be employed, such as have been previously taught in the prior art. For example, the conductive layer can be a metal foil which is conventionally laminated to this support layer. Suitable metal foils include those comprised of aluminum, zinc, copper, and the like. Suitable metal plates can be used, including those comprised of aluminum, copper, zinc, brass, and galvanized steel. Plates can also serve as a support layer. Vacuum vapor deposited metal layers such as silver, chromium, nickel, aluminum, alloys, and the like on a substrate are suitable and presently preferred, and the thickness of such a deposited metal layer can be in the range of about 20 to about 500 angstroms. Conductive layers can comprise a particulate conductor and/or semiconductor dispersed in a binder resin. For example, a conducting layer can comprise compositions of protective inorganic oxide and 30 to 70 weight percent of conductive metal particles, such as a vapor deposited conductive cermet layer as described in U.S. Pat. No. 3,880,657. See also the teachings of U.S. Pat. No. 3,245,833 relating to conductive layers employed with barrier layers. Organic conductive layers can be employed, such as one comprised of a sodium salt of a carboxyester lactone of maleic anhydride and a vinyl acetate polymer as taught in U.S. Pat. Nos. 3,007,901 and 3,262,807.

The conductive layer is overcoated with a barrier layer of this invention. While any convenient method of application can be used therefor, it is presently preferred to dissolve the copolymer of the present invention in a solvent and then to coat the solution over the conductive layer. The coating weight is such that, after solvent evaporation, the barrier layer thickness is not more than about 1 micron, preferably 0.1 micron. Particularly because of the thin barrier coatings employed in this invention, the coating is preferably carried out so as to avoid any irregularities or discontinuities in the dry coating.

In addition to the polymer, the barrier layer coating composition can contain minor amounts (on a 100 weight percent total solids basis) of optional additives, such as surfactants, levelers, plasticizers, and the like.

In a barrier layer composition, all components are dispersed and preferably dissolved in a solvent liquid. The total solids content can vary, but preferably is in about the 1 to 5 weight percent range with the balance up to 100 weight percent being the solvent. Mixtures of different solvents can be employed. Preferably, the solvents are volatile (that is, evaporable) at temperatures below about 150° C. Examples of suitable solvents include aromatic hydrocarbons, such as benzene, toluene, xylene, mesitylene, etc.; ketones, such as acetone, 2-butanone, etc.; ethers, such as cyclic ethers like tetrahydrofuran, methyl ethyl ether, etc.; halogenated aliphatic hydrocarbons, such as ethylene dichloride, chloroform, ethylene chloride, etc.; alkanols, such as isopropanol, etc.; and the like.

The barrier layer composition is usually applied by coating over the conductive layer using, for example, a technique such as knife coating, spray coating, swirl coating, extrusion hopper coating, or the like. After application, the coating is conveniently air dried.

The photoconductive charge generating layer is applied over the barrier layer.

The charge generating layer is conveniently comprised of a conventional photoconductor (or photoconductive agent) which is typically dispersed in a polymeric binder or a vacuum sublimed pigment as disclosed in U.S. Pat. No. 4,471,039 or an aggregate layer as disclosed in U.S. Pat. No. 4,175,960. The layer can have a thickness which varies over a wide range, typical thicknesses being in the range of about 0.05 to about 6 microns. As those skilled in the art appreciate, as layer thickness increases, a greater proportion of incident radiation is absorbed by a layer, but the likelihood increases of trapping a charge carrier which then does not contribute to image formation. Thus, an optimum thickness of a given such layer can constitute a balance between these competing influences.

A wide variety of materials can be employed in the charge generation layer. These materials include inorganic, and organic, including metallo-organic and polymeric, materials. Inorganic materials include, for example, zinc oxide, lead oxide and selenium. Organic materials are various particulate organic pigment materials such as phthalocyanine pigments, and a wide variety of soluble organic compounds including metallo-organic and polymeric organic photoconductors. A partial listing of representative photoconductive materials may be found, for example, in Research Disclosure, Vol. 109, May 1973, page 61, in an article entitled "Electrophotographic Elements, Materials and Processes", at paragraph IV(A) thereof. This partial listing of well-known photoconductive materials is hereby incorporated by reference.

Examples of suitable organic materials include: phthalocyanine pigments, such as a bromoindium phthalocyanine pigment described in U.S. Pat. No. 4,727,139 or a titanylphthalocyanine pigment described in U.S. Pat. No. 4,701,396; and aggregates as described in U.S. Pat. No. 4,175,960.

A wide variety of dyes or spectral sensitizing compounds can be used, such as, for example, various pyrylium dye salts, such as pyrylium, bispyrylium, thiapyrylium, and selenapyrylium dye salts, as disclosed, for example, in U.S. Pat. No. 3,250,615; fluorenes, such as 7,12-dioxo-13-dibenzo(a,h)fluorene and the like; aromatic nitro compounds of the kind disclosed in U.S. Pat. No. 2,610,120; anthrones such as those disclosed in the U.S. Pat. No. 2,670,284; quinones such as those disclosed in U.S. Pat. No. 2,670,286; benzophenones, such as those disclosed in U.S. Pat. No. 2,670,287; thiazoles, such as those disclosed in U.S. Pat. No. 3,732,301; various dyes such as cyanine (including carbocyanine, merocyanine, diarylmethane, thiazine, azine, oxazine, xanthene, phthalein, acridine, azo, anthraquinone dyes, and the like, and mixtures thereof.

The photoconductor, or mixture of photoconductors, is usually applied from a solution in a coating composition to form a charge generating layer in an element over a barrier layer of the type provided in this invention. Also typically present as dissolved solids in a photoconductor layer coating composition are a binder polymer and optional additives.

In general, such compositions may be prepared by blending the components together in a solvent liquid.

As the binder polymer, any hydrophobic organic polymer known to the photoconductive element art as a binder can be used. These polymers are preferably organic solvent soluble and, in solid form, display dielectric strength and electrical insulating properties. Suitable polymers include, for example, styrene-butadiene copolymers; polyvinyl toluene-styrene copolymers; silicone resins; styrene alkyd resins; silicone-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetals), such as poly(vinyl butyryl); polyacrylic and methacrylic esters, such as poly(methyl methacrylate), poly(n-butyl methacrylate), poly(isobutyl methacrylate), etc.; polystyrene; nitrated polystyrene; polymethylstyrene; isobutylene polymers; polyesters, such as poly[ethylene-co-alkylene-bis(alkylene-oxyaryl)phenylenedicarboxylate]; phenolformaldehyde resins; ketone resins; polyamides; polycarbonates; polythiocarbonates; poly[ethylene-co-isopropylidene-2,2-bis(ethylene-oxyphenylene)terephthalate]; copolymers of vinyl haloarylates and vinyl acetate, such as poly(vinyl-m-bromobenzoate-co-vinyl acetate); chlorinated polyolefins such as chlorinated polyethylene; and the like. Preferred polymers are polycarbonates and polyesters.

One or more hole donor agents can also be added, such as 1,1-bis(4-di-p-tolylaminophenyl) cyclohexane, as taught in U.S. Pat. No. 4,127,412, tri-p-tolylamine, and the like. Coating aids, such as levelers, surfactants, cross linking agents, colorants, plasticizers, and the like can also be added. The quantity of each of the respective additives present in a coating composition can vary, depending upon results desired and user preferences.

A photoconductive charge generating layer composition is applied by coating the composition over the barrier layer using a technique such as above described for coating a barrier layer composition. After coating, the charge generating layer composition is conveniently air dried.

An n-type charge transport layer is applied over the charge generating layer.

The charge transport layer employed in a multi-layered photoconductor element of this invention contains, as the active transport agent, any charge-transport agent which preferentially accepts and transports negative charges. A charge transport layer can contain more than one n-type charge transport agent or both n- and p-type charge transport agents, i.e., a bipolar element.

In a charge transport layer, the charge transport agents are dispersed in a polymeric binder. In general, any of the polymeric binders heretofore described for use in the photoconductor art can be used, as hereinabove described in connection with the charge generation layer.

A present preference is to employ a polyester of 4,4'-(2-norbornylidene)diphenol with terephthalic acid and azelaic acid (60/40) as a binder polymer in charge transport layers employed in the practice of this invention.

Illustrative n-type organic photoconductive materials include strong Lewis acids such as organic, including metallo-organic, materials containing one or more aromatic, including aromatically unsaturated heterocyclic, materials bearing an electron withdrawing substituent. These materials are considered useful because of their characteristic electron accepting capability. Typical electron withdrawing substituents include cyano and nitro groups; sulfonate groups; halogens such as fluorine, chlorine, bromine, and iodine; ketone groups; ester groups; acid anhydride groups; and other acid groups such as carboxyl and quinone groups. A partial listing of such representative n-type aromatic Lewis acid materials having electron withdrawing substituents includes phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrobinphenyl, 2,4,6-trinitroanisole, trichlorotrinitrobenzene, trinitro-o-toluene, 4,6-dichloro-1,3-dinitrobenzene, 4,6-dibromo-1,3-dinitrobenzene, p-dinitrobenzene, chloranil, bromanil, 2,4-trinitro-9-fluorenone, 2,4,5,7-tetranitrofluorenone, trinitroanthracene, dinitroacridene, tetracyanopyrene, dinitroanthraquinone, and mixtures thereof.

Other useful n-type charge-transport materials which may be employed in the present invention are conventional n-type organic photoconductors, for example, complexes of 2,4,6-trinitro-9-fluorenone and poly(vinylcarbazole) provide useful n-type charge-transport materials. Still other n-type organic, including metallo-organo, photoconductive materials useful as n-type charge-transport materials in the present invention are any of the organic photoconductive materials known to be useful in electrophotographic processes such as any of the materials described in *Research Disclosure*, Vol. 109, May 1973, pages 61-67, paragraph IV (A) (2) through (13) which are n-type photoconductors. The foregoing *Research Disclosure* article is incorporated herein by reference thereto.

A presently preferred n-type charge transport agent is 4H-thiopryan-1,1-dioxide. If it is desired to have a bipolar element, p-type charge transport agents should be incorporated.

Examples of suitable p-type organic charge transport agents include:

1. Carbazoles including carbazole, N-ethyl carbazole, N-isopropyl carbazole, N-phenyl carbazole, halogenated carbazoles, various polymeric carbazole materials such as poly(vinyl carbazole), halogenated poly(vinyl carbazole), and the like.

2. Arylamines including monoarylamines, diarylamines, triarylamines and polymeric arylamines. Specific arylamine organic photoconductors include the nonpolymeric triphenylamines illustrated in U.S. Pat. No. 3,180,730; the polymeric triarylamines described in U.S. Pat. No. 3,240,597; the triarylamines having at least one of the aryl radicals substituted by either a vinyl radical or a vinylene radical having at least one active hydrogen-containing group, as described in U.S. Pat. No. 3,567,450; the triarylamines in which at least one of the aryl radicals is substituted by an active hydrogen-containing group, as described by U.S. Pat. No. 3,658,520; and tritolylamine.

3. Polyarylalkanes of the type described in U.S. Pat. Nos. 3,274,000; 3,542,547; and 3,615,402. Preferred polyarylalkane photoconductors are of the formula:

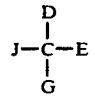

wherein:

D and G, which may be the same or different, each represent an aryl group, and

J and E which may be the same or different, each represent hydrogen, an alkyl group, or an aryl group, and at least one of D, E and G contain an amino substituent.

An especially useful charge-transport material is a polyarylalkane wherein J and E are each hydrogen, aryl or alkyl, and D and G are each substituted aryl groups having as a substituent thereof a group of the formula:

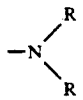

wherein:

R is an unsubstituted aryl group, such as phenyl or alkyl-substituted aryl, such as a tolyl group. Examples of such polyarylalkanes may be found in U.S. Pat. No. 4,127,412.

4. Strong Lewis bases, such as aromatic compounds, including aromatically unsaturated heterocylic compounds free from strong electron-withdrawing groups. Examples include tetraphenylpyrene, 1-methylpyrene, perylene, chrysene, anthracene, tetraphene, 2-phenyl naphthalene, azapyrene, fluorene, fluorenone, 1-ethylpyrene, acetyl pyrene, 2,3-benzochrysene, 3,4-benzopyrene, 1,4-bromopyrene, phenylindole, polyvinyl carbazole, polyvinyl pyrene, polyvinyltetracene, polyvinyl perylene and polyvinyl tetraphene.

5. Hydrazones, including the dialkyl-substituted aminobenzaldehyde-(diphenylhydrazones) of U.S. Pat. No. 4,150,987; alkylhydrazones and arylhydrazones as described in U.S. Pat. Nos. 4,554,231; 4,487,824; 4,481,271; 4,456,671; 4,446,217; and 4,423,129, which are illustrative of the p-type hydrazones.

Other useful p-type charge transports are the p-type photoconductors described in Research Disclosure, Vol. 109, May, 1973, pages 61-67, paragraph IV (A) (2) through (13).

In addition to a charge transport agent and a binder polymer, a charge transport layer may contain various optional additives, such as surfactants, levelers, plasticizers, and the like.

Presently preferred additives are poly(dimethyl-co-methyl phenyl siloxane), a surfactant sold by Dow-Corning Company as DC-510.

On a 100 weight percent total solids basis, a charge transport layer is comprised of about 20 to about 60 weight percent of charge transport agents, about 40 to about 80 weight percent binder polymer; and less than 1 weight percent of total additives.

The charge transport layer solid components are conveniently preliminarily dissolved in a solvent to produce a charge transport layer composition containing about 8 to 15 weight percent solids with the balance up to 100 weight percent being the solvent. The solvents are as hereinabove described.

Coating of the charge transport layer composition over the charge generation layer can be accomplished using a coating technique such as hereinabove included. After coating, this charge transport layer composition is conveniently air dried.

The thickness of a charge transport layer can vary, but is preferably in the range from about 5 to about 25 microns.

A single charge transport layer can contain more than one applied coating of compositions of n-type charge transport agents.

Photoconductive elements of this invention characteristically display dark decay values of not more than about 20 V/sec.

The term "dark decay" as used herein means the loss of electric charge from a charged photoconductor element under dark conditions and in the absence of activating radiation.

For present purposes of measuring dark decay, a multilayered photoconductor element of the type under consideration herein is charged upon its charge transport layer with a positive charge so that the surface potential is in the range of about 400 to 600 volts. Thereafter, the rate of charge dissipation in volts per second is measured. The element is preliminary dark adapted and maintained in the dark without activating radiation during the evaluation using ambient conditions of temperature and pressure.

The invention is further illustrated by the following examples:

EXAMPLE 1

No barrier was coated between the charge generation layer and the conducting layer in this element. Nickelized poly(ethylene terephthalate) conductive film was prepared by vacuum deposition of nickel on 4 mil (~100 micron) poly(ethylene terephthalate) (Estar TM, Eastman Kodak Co.) The conductive film support has O.D. 0.4. A thin layer of titanylfluorophthalocyanine, $[(4\text{-}F)_4Pc]TiO$, was coated on the conducting layer to provide a charge generation layer. This pigment, $[(4\text{-}F)_4Pc]TiO$, was made following Examples 1 and 2 of U.S. Pat. No. 4,701,396. Eight grams of $[(4\text{-}F)_4Pc]TiO$, 4 g of poly(4,4'-[2-norbornylidene]diphenol carbonate), 93.6 g of 1,1,2-trichloroethane, and 30 g of dichloromethane were ball milled for two and one-half days. This was diluted with 344.4 g of dichloromethane and 0.03 g of poly(dimethyl-co-methylphenylsiloxane) surfactant (DC510 of Dow-Corning Co.) It was then extrusion hopper coated onto the conductive support to give a dry thickness of 0.5 micron. An electron charge transport layer was then formed by coating a dichloromethane solution of 4-dicyanomethylene-2,6-diphenyl-4H-thiopyran-4-one-1,1-dioxide (30%) and poly(4,4'-[2-norbornylidene]bisphenylene terephthalate-co-azelate) 60/40 polyester binder thereover and dried. The resulting layer thickness was about 10μ. The completed film was then corona charged positively to 500 volts in dark. The drop of surface potential was measured for 2 seconds and the rate recorded as V/sec. This is designated as dark decay. Then monochromatic light at 830 nm was turned on and film was discharged to its residual potential. The light intensity is 1 erg/cm$^2$/sec. The amount of energy required to discharge the film from 500 V to 100 V is recorded. The data is shown in Table 1 below.

EXAMPLE 2

Ethylene/maleic anhydride copolymer (Tm 235° C., Molecular weight up to 500,000, purchased from Aldrich Chemical Co.) was dissolved in 2-propanol to make a 1% solution and this was coated on a nickelized poly(ethylene terephthalate) conductive film support at 0.05 g/ft$^2$ (0.54 g/m$^2$) dry coverage and dried at 90° C. for 2 min. Hence, a thin barrier layer (0.5μ) is formed. The charge generation layer and the charge transport layer were prepared as stated in Example 1 and electrical data obtained on the product film is shown in Table I below.

EXAMPLE 3

The procedure of Example 2 is repeated except that the dry coverage of ethylene/maleic anhydride copolymer was 0.01 g/ft$^2$ (0.11 g/m$^2$) and the barrier layer was 0.1 micron thick.

EXAMPLE 4

Methyl vinyl ether/maleic anhydride copolymer (high molecular weight, specific viscosity 2.6–3.5, from Aldrich Chemical Co.) was dissolved in methyl ethyl ketone to make 2% solution and this was coated on a nickelized poly(ethylene terephthalate) film support prepared as above at 0.01 g/ft$^2$ (0.11 g/m$^2$) dry coverage and dried. The charge generating layer and the charge transport layers were prepared and the film was tested as illustrated in Example 1.

EXAMPLE 5

The procedure in Example 4 was repeated except that the dry coverage of methyl vinyl ether/maleic anhydride copolymer was 0.005 g/ft$^2$ (0.054 g/m$^2$) so that the barrier layer was 0.05 micron thick. The electrical characteristics of this film were measured and the results are shown in Table I below.

EXAMPLE 6

Styrene/maleic anhydride copolymer (Ave M. W. 350,000 density 1.27, from Aldrich Chemical Co.) was dissolved in methyl ethyl ketone to make a 1% solution and this solution was coated on a nickelized poly(terephthalate) film support prepared as described above at 0.05 g/ft$^2$ (0.54 g/m$^2$) dry coverage and dried. This gave a barrier layer of 0.5 micron thickness. The procedure of Example I was then followed. Data obtained is shown in Table I.

EXAMPLE 7

No barrier layer was coated between the charge generation layer and the conducting layer in this element. An indium tin oxide coated 3 mil Mylar TM which has O.D. 0.06 and resistivity of 500 ohms/square was used as conductive support. A thin layer of $[(4\text{-}F)_4]TiO$ charge generation layer was coated following Example 3 of U.S. Pat. No. 4,701,396. The thickness of the layer was 1.5μ. The charge transport layer was made as that of Example 1 in this invention and the resulting film was tested. Data is shown in Table I.

EXAMPLE 8

Methyl vinyl ether/maleic anhydride copolymer (high molecular weight, specific viscosity 2.6–3.5, from Aldrich Chemical Co.) was dissolved in methyl ethyl ketone to make 2% solution. This was hand coated with a 1.0 mil coating blade on the indium tin oxide conductive support. The charge generation layer and charge transport layer were made as Example 7. Data obtained is shown in Table I.

EXAMPLE 9

The procedure of Example 8 was repeated except that 1% solution of ethylene/maleic anhydride copolymer in 2-propanol was coated on the indium tin oxide conductive support.

EXAMPLE 10

The procedure of Example 7 was repeated except that an Inconel coated poly(ethylene terephthalate) conductive support (O.D. 0.4) was used.

EXAMPLE 11

The procedure of Example 8 was repeated except that an Inconel coated conductive support was used.

EXAMPLE 12

The procedure of Example 9 was repeated except that an Inconel coated conductive support was used.

EXAMPLE 13

The procedure of Example 7 was repeated except that a stainless steel coated poly(ethylene terephthalate) conductive support (O.D. 0.4) was used.

EXAMPLE 14

The procedure of Example 8 was repeated except that a stainless steel conductive support was used.

TABLE I

| Example No. | Conducting Layer Material | Charge Barrier | Dark Decay V/sec | Relative Exposure Discharge 500V-100V |
|---|---|---|---|---|
| 1 | Ni | None | >50 | — |
| 2 | Ni | EnMd | 1 | 34.2 |
| 3 | Ni | EnMd | 2 | 33.2 |
| 4 | Ni | MvMd | 5 | 39.1 |

TABLE I-continued

| Example No. | Conducting Layer Material | Charge Barrier | Dark Decay V/sec | Relative Exposure Discharge 500V-100V |
|---|---|---|---|---|
| 5 | Ni | MvMd | 3 | 30.4 |
| 6 | Ni | StyMd | 3 | 41.3 |
| 7 | ITO | None | >50 | — |
| 8 | ITO | MvMd | 16 | 100 |
| 9 | ITO | EnMd | 17 | 98.4 |
| 10 | Inconel* | None | 35 | — |
| 11 | Inconel | MvMd | 9 | 87.5 |
| 12 | Inconel | EnMd | 17 | 81.5 |
| 13 | Stainless steel | None | 31 | — |
| 14 | Stainless steel | MvMd | 12 | 82.1 |

The relative exposure is obtained by arbitrarily assigning a value of 100 to the energy required to discharge from 500V to 100V in Example 8 and is a ratio of discharge energy of other examples to that of Example 8. Because of high dark decay in Examples 1, 7, 10, and 13, no relative exposure was recorded in those examples.
*Inconel is an alloy of 76% Ni, 15% Cr, and 9% Fe.
EnMd: ethylene/maleic anhydride copolymer.
MvMd: methyl vinyl ether/maleic anhydride copolymer.
StyMd: styrene/maleic anhydride copolymer.

The foregoing specification is intended as illustrative and is not to be taken as limiting. Still other variations within the spirit and the scope of the invention are possible and will readily present themselves to those skilled in the art.

I claim:

1. A multilayer photoconductor element comprising:

a support layer;

a conductive layer adhered to one side of the support layer;

a barrier layer that is less than about 1.0 micron in thickness, said barrier layer adhered to the conductive layer and consisting essentially of a copolymer of (1) at least one olefinically unsaturated carboxylic acid anhydride containing 4 through 8 atoms per molecule, and (2) at least one vinyl monomer, wherein the weight ratio of (1) to (2) is in the range of about 10:1 to about 1:10;

a charge generation layer adhered to the barrier layer; and a charge transport layer adhered to the charge generation layer wherein the charge transport layer comprises an n-type transport agent.

2. The photoconductor element of claim 1 wherein said carboxylic acid anhydride is maleic anhydride.

3. The photoconductor element of claim 1 wherein said vinyl monomer is ethylene.

4. The photoconductor element of claim 1 wherein said vinyl monomer is styrene.

5. The photoconductor element of claim 1 wherein said vinyl monomer is vinyl methyl ether.

* * * * *